United States Patent [19]

Anzai et al.

[11] Patent Number: 4,480,908

[45] Date of Patent: Nov. 6, 1984

[54] THERMAL FIXING ROLLER SYSTEM IN A COPYING MACHINE

[75] Inventors: Shunju Anzai; Yoshiaki Ibuchi, both of Nara; Akihiko Taniguchi, Kyoto, all of Japan

[73] Assignee: Sharp Kabushiki Kisha, Osaka, Japan

[21] Appl. No.: 389,917

[22] Filed: Jun. 18, 1982

[30] Foreign Application Priority Data

Jun. 30, 1981 [JP] Japan ..... 56-102686

[51] Int. Cl.[3] ..... G03G 15/00

[52] U.S. Cl. ..... 355/14 FU; 355/3 FU

[58] Field of Search ..... 355/14 FU, 3 FU

[56] References Cited

U.S. PATENT DOCUMENTS 4,324,486 4/1983 Nishikawa ..... 355/14 FU 4,385,826 5/1983 Itoh ..... 355/14 FU

*Primary Examiner*—John Gonzales

*Assistant Examiner*—David Warren

*Attorney, Agent, or Firm*—Birch, Stewart, Kolasch & Birch

[57] ABSTRACT

A thermal fixing roller system includes a heater roller and a pressure roller between which a copy paper is driven to travel for fixing a toner image carried on the copy paper. A heater is disposed in the heater roller for maintaining the surface temperature of the heater roller around a preselected temperature. When the main power supply switch is switched on, the heater roller and the pressure roller are driven to rotate before the surface temperature of the heater roller reaches the preselected temperature. When the surface temperature of the heater roller reaches the preselected temperature, a ready lamp is energized, and the rotation of the heater roller and the pressure roller is terminated, at which the pressure roller is warmed up to a desired temperature.

3 Claims, 5 Drawing Figures

THERMAL FIXING ROLLER SYSTEM IN A COPYING MACHINE

BACKGROUND AND SUMMARY OF THE INVENTION

The present invention relates to a copying machine and, more particularly, to a drive system for a thermal fixing roller employed in a copying machine.

Generally, a thermal fixing roller system includes a pair of rollers. One of the rollers is a heater roller within which a heater is disposed to heat the heater roller to a desired temperature suited for the thermal fixing operation. The other roller is a pressure roller which contacts the heater roller and creates a predetermined pressure against the heater roller. A copy paper carrying a toner image thereon is driven to travel between the heater roller and the pressure roller in such a manner that the toner image contacts the heater roller, whereby the toner image is thermally fixed while the copy paper travels through the thermal fixing roller system. The pair of rollers are driven to rotate while the fixing operation is conducted.

In the conventional thermal fixing roller system, when the main power supply is initiated, the heater disposed in the heater roller is energized to heat up the heater roller to a preselected temperature. When the heater roller reaches the preselected temperature after the above-mentioned preparation period, a ready lamp is activated and the copying operation is conducted in response to the actuation of the copy button. During the preparation period, a pair of rollers in the thermal fixing roller system are not driven to rotate to minimize the power dissipation. A temperature sensor is provided for detecting the surface temperature of the heater roller, and a control circuit is connected to the heater so as to maintain the surface temperature of the heater roller within a predetermined range.

As discussed above, in the conventional system, the heater roller and the pressure roller do not rotate during the preparation period. The pressure roller contacts the heater roller at a fixed position. Thus, the pressure roller is maintained at the ambient temperature except for the fixed position which contacts the heater roller. Under these conditions when the pair of rollers are driven to rotate in response to the actuation of the copy button, great amount of heat energy is absorbed by the pressure roller. The surface temperature of the heater roller is reduced and, therefore, the heater disposed in the heater roller is energized to heat up the heater roller. This recovering operation takes a considerably long period if the ambient temperature is low or the power supply voltage level is low. It will be clear that a desired fixing operation is not achieved until the heater roller is again heated up to the preselected temperature.

Accordingly, an object of the present invention is to provide a novel thermal fixing roller system which ensures a stable fixing operation.

Another object of the present invention is to maintain both of the heater roller and the pressure roller at a preselected temperature before initiating the actual copying operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, the heater roller and the pressure roller are driven to rotate during the preparation period. Accordingly, when the heater roller reaches the preselected temperature and the ready lamp is energized, the heat energy flowing from the heater roller to the pressure roller is negligible when the pair of rollers are rotated in response to the actuation of the copy button.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
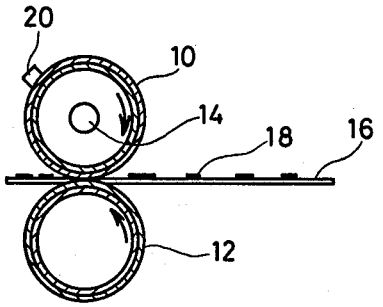
FIG. 1 is a schematic sectional view of an embodiment of a thermal fixing roller system of the present invention.

A thermal fixing roller system generally includes a heater roller 10 and a pressure roller 12. A heater 14 is disposed in the heater roller 10 in order to heat the heater roller 10 up to a desired temperature. The heater roller 10 and the pressure roller 12 are driven to rotate in the direction shown by the arrows in FIG. 1, and a copy paper 16 is driven to travel between the heater roller 10 and the pressure roller 12. A toner image 18 carried on the copy paper 16 contacts the heater roller 10 as the copy paper 16 travels between the heater roller 10 and the pressure roller 12, whereby the toner image 18 is thermally fixed. A temperature sensor 20 is disposed at a predetermined position so as to detect the surface temperature of the heater roller 10.

Figure 2:
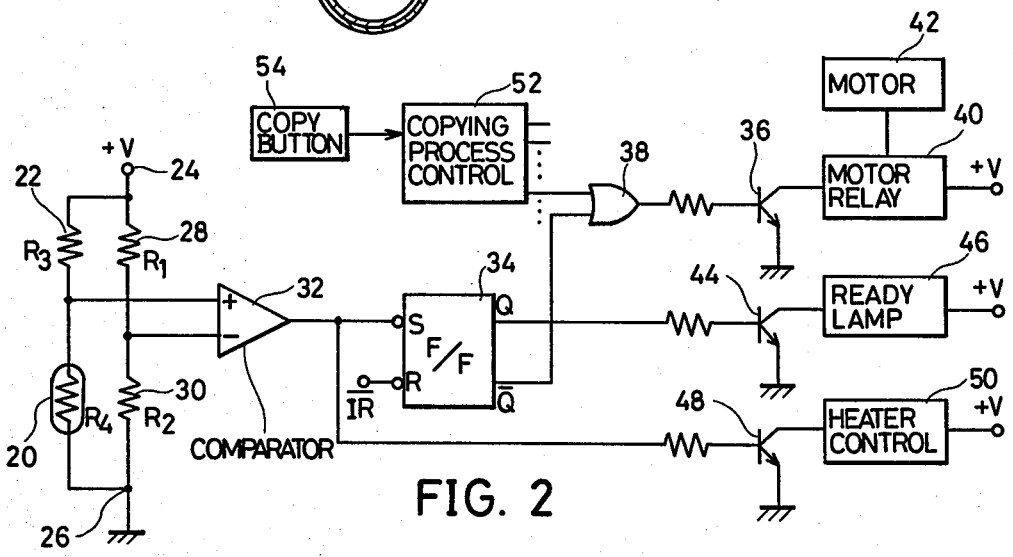
FIG. 2 is a circuit diagram of an embodiment of a control circuit for the thermal fixing roller system of the present invention.

FIG. 2 shows an embodiment of a control circuit of the present invention for activating the thermal fixing roller system of FIG. 1. The temperature sensor 20 is preferably a thermistor of which the resistance value reduces as the temperature increases. The thermistor 20 is connected to a resistor 22 ($R_3$) in a series fashion, and the series circuit is connected between a power supply terminal 24 and a ground terminal 26. Resistors 28 ($R_1$) and 30 ($R_2$) are connected with each other in a series fashion, and the series circuit ($R_1$, $R_2$) is connected to the series circuit ($R_3$, 20) in a parallel fashion. A comparator 32 is provided of which a negative input terminal is connected to the node provided between the resistors 28 and 30 for receiving a reference voltage level corresponding to a preselected temperature, for example, 180° C. The reference voltage level is a divided voltage determined as follows.

$$\frac{R_2}{R_1 + R_2} V$$

A positive input terminal of the comparator 32 is connected to the node provided between the resistor 22 and the thermistor 20 for receiving a detection voltage which is determined as follows when the resistance value of the thermistor 20 is $R_4$.

$$\frac{R_4}{R_4 + R_3} V$$

The resistance values $R_1$, $R_2$ and $R_3$ are selected to satisfy the following condition when the surface temperature of the heater roller 10 is above the preselected temperature 180° C.

$$\frac{R_2}{R_1 + R_2} > \frac{R_4}{R_3 + R_4}$$

Accordingly, when the surface temperature of the heater roller 10 detected by the thermistor 20 becomes higher than or equal to the preselected temperature 180° C., the output signal of the comparator 32 changes from the logic "H" to the logic "L". More specifically, the output signal of the comparator 32 bears the logic "H" while the surface temperature of the heater roller 10 is below the preselected temperature 180° C., and bears the logic "L" when the surface temperature of the heater roller 10 becomes higher than or equal to the preselected temperature 180° C.

The output signal of the comparator 32 is applied to a set input terminal of a flip-flop 34. The flip-flop 34 is set when the output signal of the comparator 32 bears the logic "L". The reset input terminal of the flip-flop 34 receives an inverted initial reset signal $\overline{IR}$ which is developed when the main power supply of the copying machine is initiated. The reset output signal $\overline{Q}$ of the flip-flop 34 is applied to a base electrode of a transistor 36 via an OR gate 38. The transistor 36 functions to switch the power supply to a motor relay 40 which drives a motor 42 connected to the heater roller 10 and the pressure roller 12. That is, when the signal of the logic "H" is applied to the transistor 36, the heater roller 10 and the pressure roller 12 are driven to rotate.

The set output signal Q of the flip-flop 34 is applied to a base electrode of a transistor 44. The transistor 44 functions to switch the power supply to a ready lamp 46, whereby the ready lamp 46 is enabled when the surface temperature of the heater roller 10 reaches the preselected temperature 180° C. at which the flip-flop 34 is turned to the set condition.

The output signal of the comparator 32 is further applied to a base electrode of a transistor 48 in order to activate a heater control circuit 50. When the surface temperature of the heater roller 10 is below the preselected temperature 180° C., the output signal of the comparator 32 bears the logic "H" and, therefore, the transistor 48 is switched on. The heater control circuit 50 is supplied with power for energizing the heater 14 disposed in the heater roller 10. When the surface temperature of the heater roller 10 reaches the preselected temperature 180° C., the output signal of the comparator 32 changes to the logic "L" and, therefore, the transistor 48 is switched off to terminate the power supply to the heater control circuit 50.

The other input terminal of the OR gate 38 is connected to receive a control signal developed from a copying process control circuit 52. The copying process control circuit 52 is a conventional one which develops various control signals in accordance with the execution of the copying operation. The copying process control circuit 52 develops the control signal of the logic "H" to be applied to the OR gate 38 when a copy button 54 is actuated after the ready lamp 46 is energized. That is, the heater roller 10 and the pressure roller 12 are driven to rotate when the copy button 54 is actuated under the condition where the ready lamp 46 is energized.

An operational mode of the control circuit of FIG. 2 is as follows. When the main power switch is switched on, the initial reset signal is developed. The inverted initial reset signal $\overline{IR}$ is applied to the reset input terminal of the flip-flop 34 to reset the flip-flop 34. The reset output signal $\overline{Q}$ bears the logic "H" and, therefore, the transistor 36 is switched on via the OR gate 38. Accordingly, the heater roller 10 and the pressure roller 12 are driven to rotate when the main power supply is initiated. At a same time, the heater control circuit 50 is activated because the surface temperature of the heater roller 10 is below the preselected temperature 180° C. and the output signal of the comparator 32 bears the logic "H". The heater 14 disposed in the heater roller 10 is energized to heat up the heater roller 10.

The surface temperature of the heater roller 10 is gradually increased, and the surface temperature of the pressure roller 12 is also gradually increased because the heater roller 10 and the pressure roller 12 are driven to rotate by the motor 42. When the surface temperature of the heater roller 10 reaches the preselected temperature 180° C., the output signal of the comparator 32 changes from the logic "H" to the logic "L". The flop-flop 34 is turned to the set condition. The set output signal Q of the flip-flop 34 is applied to the transistor 44 for activating the ready lamp 46. Sine the reset output signal $\overline{Q}$ is changed from the logic "H" to the logic "L", the transistor 36 is switched off to terminate the rotation of the heater roller 10 and the pressure roller 12. Since the output signal of the comparator 32 changes from the logic "H" to the logic "L", the energization of the heater 14 is terminated. Thereafter, the heater 14 is energized in a controlled manner to maintain the surface temperature of the heater roller 10 around the preselected temperature 180° C.

Under these conditions when the copy button 54 is actuated, the copying operation is conducted in accordance with the control signals developed from the copying process control circuit 52. The control signal of the logic "H" is applied to the transistor 36 via the OR gate 38 to energize the motor 42. The heater roller 10 and the pressure roller 12 are driven to rotate to perform the fixing operation. Since the entire surface of the pressure roller 12 is heated up to a desired temperature during the rotation thereof in the preparation period, the heat energy absorbed by the pressure roller 12 is negligible. Accordingly, a desired fixing operation is conducted by the thermal fixing roller system.

In the embodiment of FIG. 2, the heater roller 10 and the pressure roller 12 are driven to rotate when the main power supply switch is switched on. This lengthens the preparation period during which the heater roller 10 reaches the preselected temperature 180° C. Furthermore, the solid toner attached to the heater roller 10 may damage the rollers 10 and 12 because the rollers 10 and 12 are driven to rotate before the toner is fused.

Figure 3:
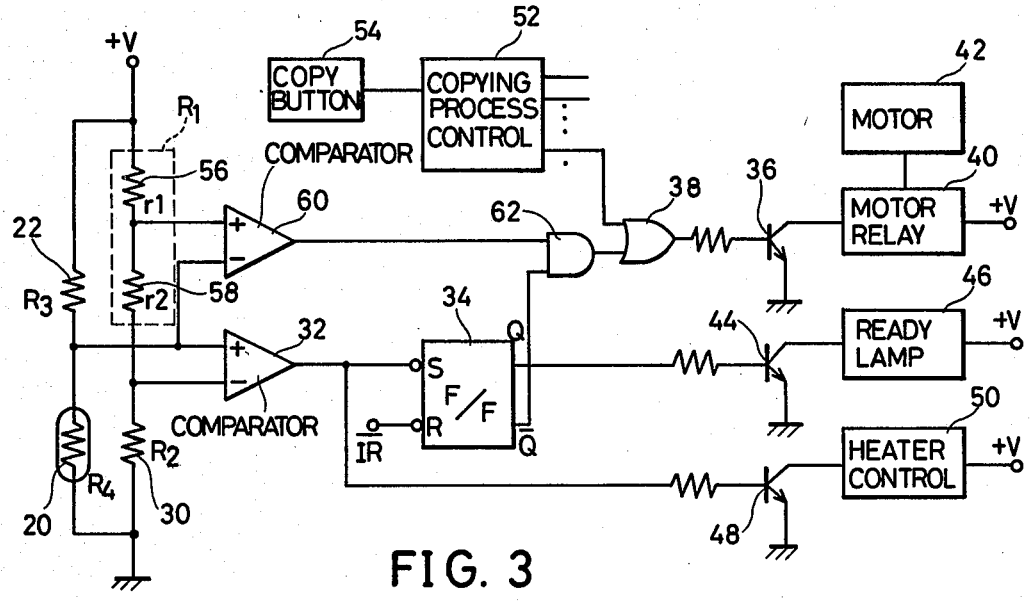
FIG. 3 is a circuit diagram of another embodiment of a control circuit for the thermal fixing roller system of the present invention.

FIG. 3 shows another embodiment of the control circuit of the thermal fixing roller system of the present invention, which minimizes the above-mentioned defects. Like elements corresponding to those of FIG. 2 are indicated by like numerals. In the embodiment of FIG. 3, the heater roller 10 and the pressure roller 12 are driven to rotate after the surface temperature of the heater roller 10 reaches a preselected temperature, for example, 160° C. which is slightly lower than the above-mentioned preselected temperature 180° C.

The resistor 28 ($R_1$) is divided into two resistors 56 ($r_1$) and 58 ($r_2$). Another comparator 60 is provided of which a positive input terminal is connected to the node provided between the resistors 56 and 58 to receive a reference voltage corresponding to the preselected temperature 160° C. The negative input terminal of the comparator 60 is connected to the node provided between the resistor 22 and the thermistor 20 to receive the data voltage. The resistance values of the resistors $r_1$, $r_2$, $R_3$ and $R_4$ are selected to satisfy the following condition when the surface temperature of the heater roller 10 is above the preselected temperature 160° C.

$$\frac{R_2 + r_2}{R_2 + r_1 + r_2} > \frac{R_4}{R_3 + R_4}$$

where $R_4$ represents the resistance value of the thermistor 20.

That is, the output signal of the comparator 60 bears the logic "L" while the surface temperature of the heater roller 10 is lower than the preselected temperature 160° C., and bears the logic "H" when the surface temperature of the heater roller 10 becomes equal to or higher than the preselected temperature 160° C.

The output signal of the comparator 60 is applied to one input terminal of an AND gate 62. The other input terminal of the AND gate 62 is connected to receive the reset output signal $\overline{Q}$ of the flip-flop 34. An output signal of the AND gate 62 is applied to the base electrode of the transistor 36 via the OR gate 38 for controlling the rotation of the heater roller 10 and the pressure roller 12.

An operational mode of the control circuit of FIG. 3 is as follows. When the main power supply switch is switched on, the flip-flop 34 is reset. Since the ambient temperature is lower than the preselected temperature 160° C. (180° C.), the output signal of the comparator 32 bears the logic "H". The heater control circuit 50 is energized to heat the heater roller 10 through the use of the heater 14 disposed in the heater roller 10. The output signal of the comparator 60 bears the logic "L" and, therefore, the motor relay 40 is not energized even though the reset output signal $\overline{Q}$ of the flip-flop 34 bears the logic "H". Thus, the heater roller 10 and the pressure roller 12 are not rotated. When the surface temperature of the heater roller 10 reaches the preselected temperature 160° C., the output signal of the comparator 60 changes from the logic "L" to the logic "H". The AND gate 62 develops the output signal of the logic "H" because the reset output signal $\overline{Q}$ of the flip-flop 34 bears the logic "H" as already discussed above. The transistor 36 is switched on to energize the motor relay 40. That is, the heater roller 10 and the pressure roller 12 begin to rotate when the surface temperature of the heater roller 10 reaches the preselected temperature 160° C. The surface temperature of the heater roller 10 may be reduced, but the surface temperature of the heater roller 10 and the pressure roller 12 gradually increases while the rotation thereof.

When the surface temperature of the heater roller 10 reaches the preselected temperature 180° C., the output signal of the comparator 32 changes from the logic "H" to the logic "L". The rotation of the heater roller 10 and the pressure roller 12 is terminated, and the ready lamp 46 is activated.

The power dissipation is reduced as compared with the embodiment of FIG. 2 because the heater roller 10 and the pressure roller 12 are rotated after the surface temperature of the heater roller 10 reaches the preselected temperature 160° C. Furthermore, any toner attached to the heater roller 10 is fused before the rollers 10 and 12 begin to rotate and, therefore, the surfaces of the heater roller 10 and the pressure roller 12 will not be damaged.

Figure 4:
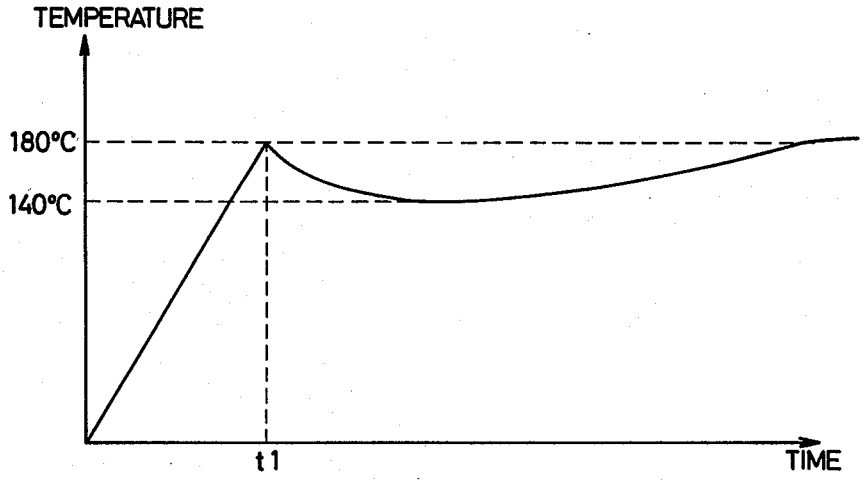
FIG. 4 PRIOR ART
FIG. 4 is a graph showing a temperature variation of a heater roller included in the thermal fixing roller system of prior art.

FIG. 4 shows a variation of the surface temperature of the heater roller 10 in the conventional system. When the multi-copying operation is conducted immediately after the ready lamp is enabled, namely, immediately after the surface temperature of the heater roller 10 reaches the preselected temperature 180° C., the surface temperature of the heater roller 10 is reduced to 140° C. And, a considerably long period of time is required to recover the surface temperature of the heater roller 10 to the preselected temperature 180° C. This is because the electric power supplied to the heater 14 disposed in the heater roller 10 is considerably low in the actual copying operation as compared with the electric power applied to the heater 14 in the preparation period. The detection is conducted through the use of a halogen lamp (100 V, 800 W) as the heater 14, and the power supply level is 85 V. A desired fixing operation is not conducted while the surface temperature of the heater roller 10 is around 140° C.

Figure 5:
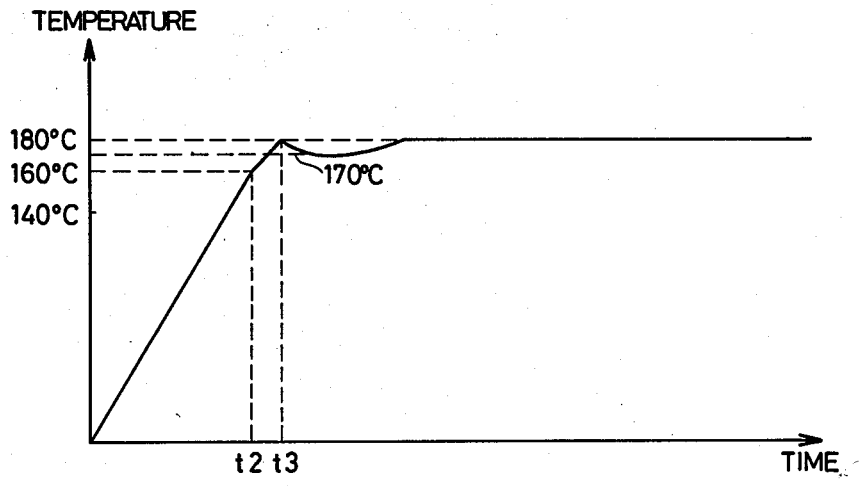
FIG. 5 is a graph showing a temperature variation of a heater roller included in the thermal fixing roller system of the present invention driven by the control circuit of FIG. 3.

FIG. 5 shows a variation of the surface temperature of the heater roller 10 when the system is driven by the control circuit of FIG. 3. The detection is conducted in the same condition as the detection of FIG. 4. The surface temperature of the heater roller 10 reaches the preselected temperature 160° C. at a time $t_2$. That is, the heater roller 10 and the pressure roller 12 are driven to rotate from the time $t_2$. The temperature increasing curve slows down, but the surface temperature of the heater roller 10 continuously raises to reach the preselected temperature 180° C. at a time $t_3$. This is because the electric power is applied to the heater 14 disposed in the heater roller 10 as much as possible in the preparation period. When the multi-copying operation is conducted immediately after the time $t_3$, the surface temperature of the heater roller 10 is reduced to 170° C. However, 170° C. ensures the preferred fixing operation. Furthermore, the surface temperature of the heater roller 10 is recovered to the preselected temperature 180° C. in a short time.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A drive system for a thermal fixing roller system in a copying machine, which includes a heater roller having a heater disposed therein and a pressure roller, wherein a copy paper is driven to travel between said heater roller and said pressure roller in order to fix a toner image carried on the copy paper, said drive system comprising:

temperature detection means for detecting a surface temperature of said heater roller;

heater control means for energizing said heater disposed in said heater roller in accordance with a detection output derived from said temperature detection means so as to maintain the surface temperature of said heater roller around a preselected temperature;

drive means for rotating said heater roller and said pressure roller; and control circuit means for activating said drive means immediately when a main power supply is initiated and before said surface temperature of said heater roller reaches said preselected temperature and for disabling said drive means when said surface temperature of said heater roller reaches said preselected temperature.

2. The drive system for a thermal fixing roller system of claim 1, wherein said preselected temperature is 180° C.

3. The drive system for a thermal fixing roller system of claim 1 or 2, further comprising a ready lamp, wherein said control circuit means enables said ready lamp when said surface temperature of said heater roller reaches said preselected temperature.

* * * * *